US006199249B1

(12) United States Patent
Gauer

(10) Patent No.: US 6,199,249 B1
(45) Date of Patent: Mar. 13, 2001

(54) DEVICE FOR DELIVERING HARNESS ELEMENTS OF A POWER LOOM

(75) Inventor: Thomas Gauer, Sargans (CH)

(73) Assignee: Stäubli AG Pfäffikon, Pfäffikon (CH)

( * ) Notice: Subject to any disclaimer, the term of this patent is extended or adjusted under 35 U.S.C. 154(b) by 0 days.

(21) Appl. No.: 09/508,188

(22) PCT Filed: Aug. 19, 1998

(86) PCT No.: PCT/CH98/00349

§ 371 Date: Mar. 8, 2000

§ 102(e) Date: Mar. 8, 2000

(87) PCT Pub. No.: WO99/13146

PCT Pub. Date: Mar. 18, 1999

(30) Foreign Application Priority Data

Sep. 8, 1997 (CH) ..... 2094/97

(51) Int. Cl.[7] ..... D03J 1/14
(52) U.S. Cl. ..... 28/208; 139/1 R
(58) Field of Search ..... 139/1 R; 28/208

(56) References Cited

U.S. PATENT DOCUMENTS 4,215,455 8/1980 Patel .
4,760,628 * 8/1988 Kaufmann ..... 28/201
4,891,871 * 1/1990 Tachibana et al. ..... 28/205
5,394,596 * 3/1995 Lindenmuller et al. ..... 28/208
5,459,913 * 10/1995 Lechner et al. ..... 28/208
5,657,794 * 8/1997 Briner et al. ..... 139/1 R

FOREIGN PATENT DOCUMENTS 30 05 071 8/1980 (DE) .
0 298 696 1/1989 (EP) .
0 646 669 4/1995 (EP) .
92/05303 4/1992 (WO) .

* cited by examiner

*Primary Examiner*—Andy Falik
(74) *Attorney, Agent, or Firm*—Venable; Gabor J. Kelemen

(57) ABSTRACT

A device is used for the transfer of harness elements (21) from a conveying member (21) in a drawing-in machine for warp yarns onto carrying members of a weaving machine, that has an ejector for removing the harness elements from the conveying member. In order to provide a device in which the carrying members are aligned as exactly as possible at the moment when the harness elements are transferred onto them, there is provided a guide roller for the harness elements which is mounted rotatably about an axis and which has guides for the carrying member which guide the carrying members in two orthogonal directions.

8 Claims, 2 Drawing Sheets

DEVICE FOR DELIVERING HARNESS ELEMENTS OF A POWER LOOM

BACKGROUND OF THE INVENTION

The invention relates to a device for the transfer of harness elements from a conveying member in a drawing-in machine for warp yarns onto carrying members of a weaving machine, with an ejector for removing the harness elements from the conveying member.

EP 500 848 has already disclosed such a device, in which the carrying members, designed as carrying rails, have an oblique entry flank directed downwards. Ejectors push the harness elements from carrying pins of a conveying member up onto these entry flanks, so that the harness elements slide along these entry flanks onto the carrying rails. The carrying rails are retained or supported against gravity by holding bolts which are capable of being moved in and out and which are fastened to a transport system. In their moved-in position, these holding bolts position the carrying rails. The holding bolts are moved out in order to allow the harness elements to pass at the relevant point.

A disadvantage of the known device mentioned is to be seen in that, in order to allow the harness elements to pass, the guidance or support of the carrying rails is temporarily removed precisely when the harness element passes over from the carrying pins of the conveying member onto the carrying rail. This puts exact alignment of the carrying pins and carrying rails at risk. This adverse circumstance can, admittedly, be eased by arranging the said guide of the carrying rails as far as possible from the conveying member, but, even then, the exact alignment of the carrying pins and carrying rails is impaired.

SUMMARY OF THE INVENTION

The invention, provides a device in which the carrying members are aligned as exactly as possible at the moment when the harness elements are transferred onto them.

This is achieved in that the carrying members or carrying rails are guided by a guide roller which is arranged very near the end of the carrying member at the conveying member and which has guides for the carrying member which guide the latter in two orthogonal directions, that is to say laterally and in the direction of gravity, during the transfer of the harness elements. The guide roller has a recess which, starting from the circumference, extends towards the axis and serves, on the one hand, for providing space for the lock-transfer of the end eyes of the harness elements and, on the other hand, for providing an engagement surface for the forward movement of the harness elements on the carrying member by means of the guide roller. In this case, the guide roller, together with the recess, forms a transfer lock for the harness elements.

The advantages achieved by means of the invention are to be seen, in particular, in that the carrying member is guided in an exact and defined manner at the moment when the harness elements are transferred from the conveying member, guidance for the lock-transfer of the harness elements being partially cancelled only when the harness element has already been taken up by the carrying member. In this case, the carrying members are always guided laterally by the guide roller, whatever the position of the latter. Another advantage is to be seen in that the guide roller executes a simple rotational movement and, at the same time, propels the harness elements some distance forwards. The guide roller may be designed for any number of adjacent carrying members. While a single harness element is being propelled forwards by the guide roller, the latter additionally holds back harness elements which have already been transported, so that these cannot be pushed towards the conveying member again.

BRIEF DESCRIPTION OF THE DRAWING

The invention is explained in more detail below by means of an example and with reference to the accompanying figures.

DETAILED DESCRIPTION OF THE PREFERRED EMBODIMENTS

Figure 1:
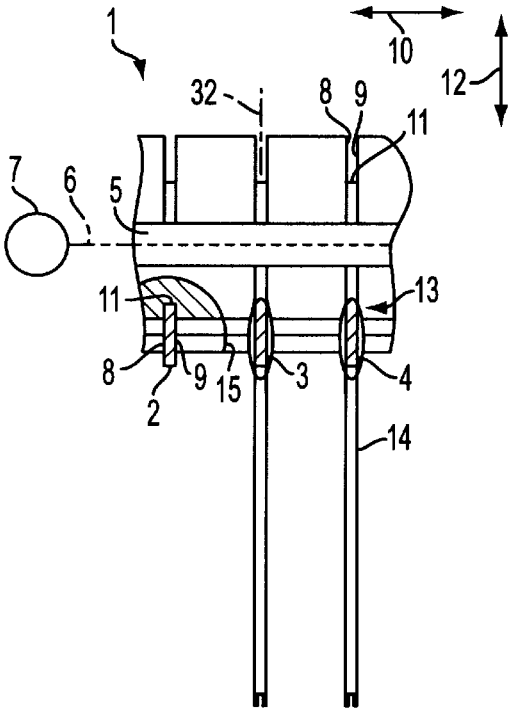
FIG. 1 is a schematic sectional view of the device according to the invention.

FIG. 1 shows a section through part of a guide roller 1 for a plurality of carrying members 2, 3, 4, which are arranged next to one another at equal intervals. The guide roller 1 is mounted on a shaft 5 rotatably about an axis 6 in a way not illustrated in any more detail, but known per se, and is connected to a drive 7. The guide roller 1 has lateral guides 8, 9 for guiding the carrying member 4 in the direction of an arrow 10 and guides 11 for guidance in the direction of an arrow 12, and therefore for guidance in two orthogonal directions. The guides 8, 9 are interrupted or widened in the region of a recess 13 and therefore do not form a closed circular ring. A harness element 14, which is located on the carrying member 4, is depicted in the recess 13. A region delimited by an arc of a circle 15 shows a section through the guide roller 1, this section in turn, being located in the region of the guides 8, 9, 11, although, in this case, the carrying member 2, which is guided by these guides 8, 9, 11, is depicted.

Figure 2:
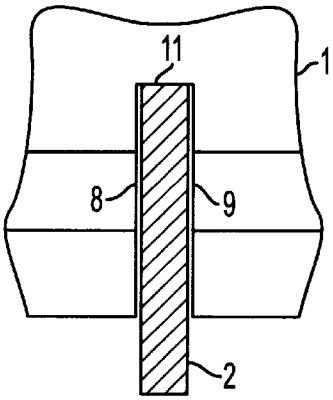
FIG. 2 shows part of the device on an enlarged scale.

FIG. 2 once again shows, on an enlarged scale, the carrying member 2 together with the guides 8, 9, 11 of the guide roller 1.

Figure 3:
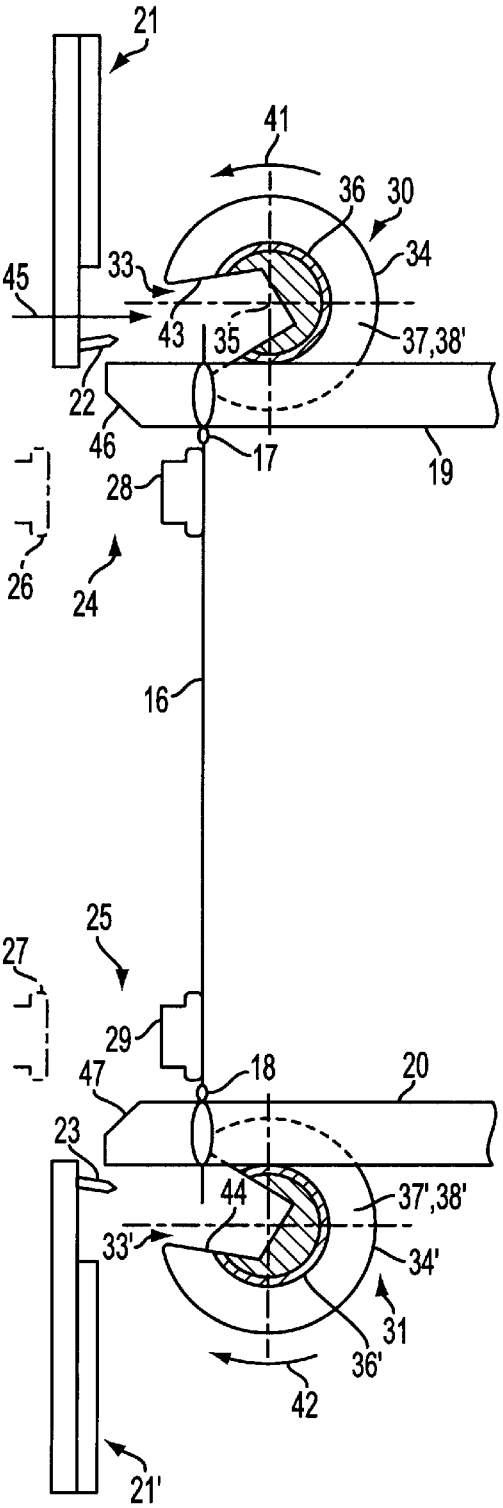
FIG. 3 shows a view of the device in a first operating phase, the said view having been pivoted through 90° in relation to FIG. 1.

FIG. 3 shows, from another viewing angle, the arrangement of the guide rollers in or in front of a drawing-in machine for warp yarns. Since the harness elements 16, illustrated diagrammatically here, have an eye 17, 18 at the top and bottom in each case, two carrying rails 19, 20 are also provided as carrying member. The drawing-in machine has, as part of a conveying member 21, 21' for each harness element, two holding bolts 22, 23, a plurality of which are arranged next to one another, for example, on a rotating chain in each case, as is known, for example, from EP 500 848 already mentioned. Moreover, the drawing-in machine preferably has two ejectors 24, 25, which are each illustrated here in the initial position 26, 27 and in the end position 28, 29. These ejectors are capable of executing a lifting movement out of the initial position into the end position. However, such ejectors 24, 25 are known per se and therefore the way in which they are driven is not described in any more detail either. A guide roller 30, 31 is also provided for each carrying rail 19, 20. The said guide rollers are illustrated in section here, the section running in a plane which is illustrated in FIG. 1 by a broken line 32 and, in principle, passes through the center of the harness elements. Thus, the recess 33, 33', which corresponds to the recess 13 (FIG. 1) and which, starting from the circumference 34, 34', extends towards the axis 35, is also rendered clearly visible. The recess 33 causes the guide 36, corresponding to the guide 11 (FIG. 1), to extend approximately over three quarters of the circumference. This proportion is greater for the lateral guides 37, 38, which correspond to the guides 8, 9 (FIG. 1). The guide roller is arranged very near the end 46, 47 of the carrying rails 19, 20 or of the carrying member and so as to be adjacent to the conveying member 21, 21'.

FIG. 4 again shows the same elements as FIG. 3. These elements are therefore also given the same reference symbols. However, the guide rollers 30, 31 and the harness element 16 have assumed a different position. The harness element 16 has been grasped by guide surfaces 39, 40 in the recesses 33, 33' and moved on the carrying rails 19, 20. The ejectors 24, 25 are still in their end positions 28, 29.

Figure 5:
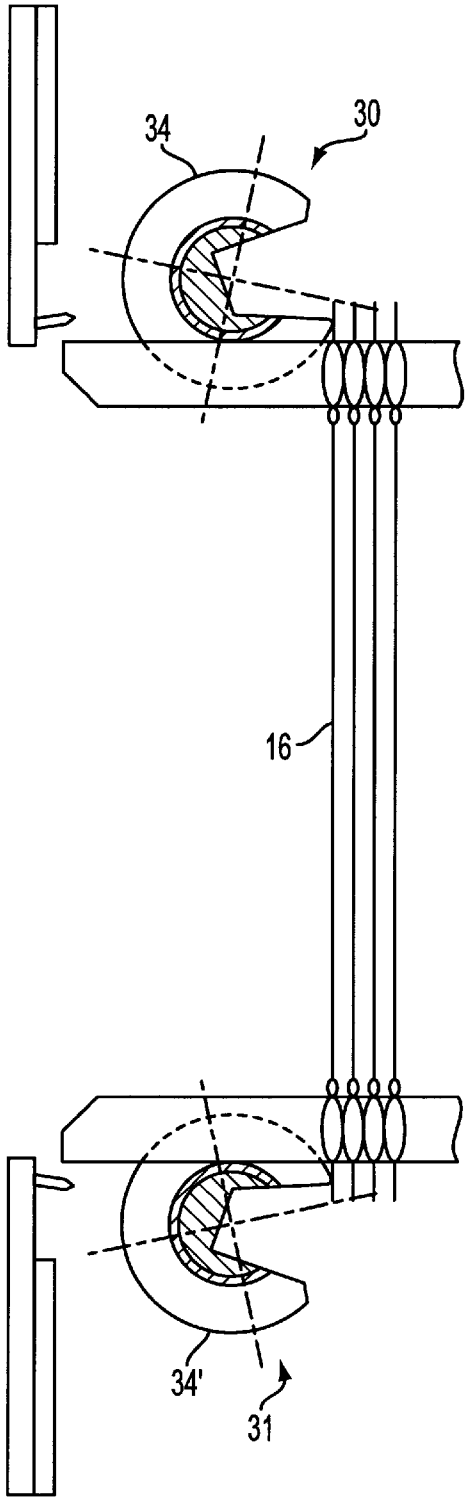

FIG. 5 shows, yet again, the same elements as FIG. 3. Here, the harness element 16 is illustrated as having been transported even further.

Figure 4:
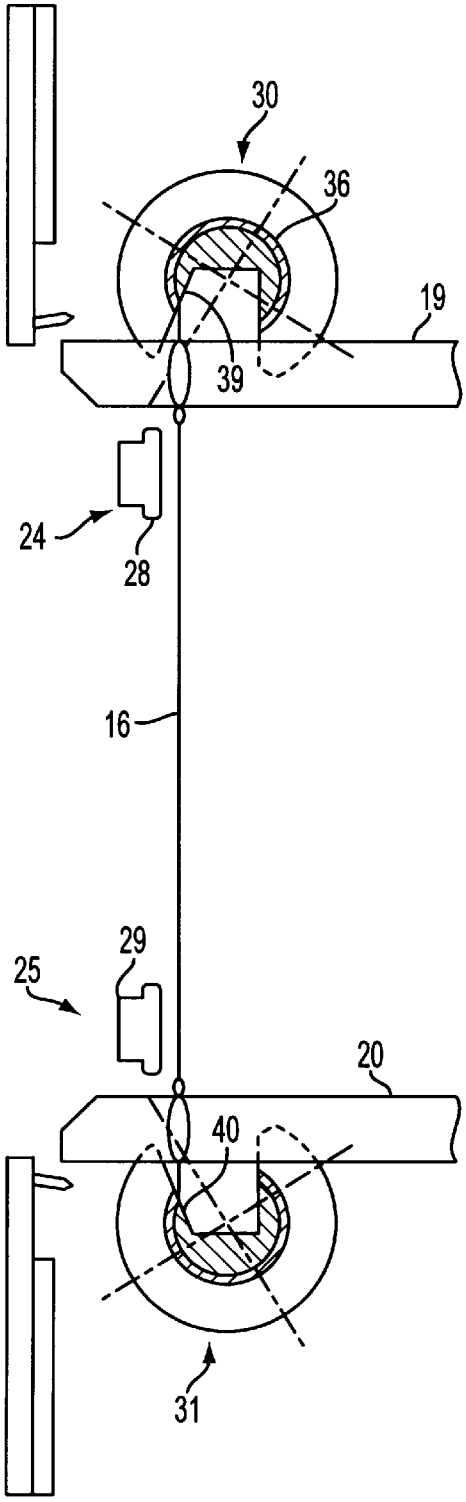
FIGS. 4 and 5 show the device in two further operating phases.

The device operates as follows: A harness element 16, such as, for example, a heald or drop wire, is guided in a way known per se, on two holding bolts 22, 23, in front of the carrying rails 19, 20 by synchronously rotating conveying members 21, 21'. The ejectors 24, 25 then move out of the initial positions 26, 27 into the end positions 28, 29, the end eyes 17, 18 of the harness element 16 being stripped from the holding bolts 22, 23 in the direction of an arrow 45 and being pushed onto the carrying rails 19, 20. During this time, the carrying rails 19, 20 are guided laterally by the guides 37, 38, 37' 38' and vertically by the guide 36, 36'. The harness element 16 is then grasped by the guide rollers 30, 31, which rotate in the direction of the arrows 41, 42. Since the channel defined by the guides 8, 9, 11 (FIG. 1) and 36, 37, 38 and 36', 37' 38' is as narrow as a carrying rail 19, 20, but narrower than an end eye 17, 18, a boundary 43, 44 of the recess 33, 33' forms a guide surface 39, 40 (FIG. 4), along which the end eyes 17, 18 slide and, at the same time, are moved further on the carrying rail 19, 20. In this case, the guidance of the carrying rails 19, 20 by the guides 36, 36' is lost for a short time in the region of the position as shown in FIG. 4, but this is not a disadvantage, since the transfer of the harness element 16 onto the carrying rails 19, 20 has already taken place. The lateral guidance of the carrying rails by the guides 8, 9 (FIG. 1) and 37, 38 and 37', 38' is always maintained. In the position shown in FIG. 5, guidance is once again effective on all sides. From then on, the guide roller 30, 31, via the circumference 34, 34', supports the harness elements against backward movement.

The rotational movement of the guide roller may be continuous or controlled in a specific manner by means of control and monitoring elements. In the case of continuous movement, the position of the recesses 13, 33 give rise to periods of time in which the ejectors 24, 25 can eject the harness element 16. However, the movement of the guide roller may also be governed by the conveying member 21, so that the guide roller waits in a position according to FIG. 3 until the ejectors 24, 25 have performed their task. The guide roller then executes a complete revolution as quickly as possible, in order to return to the position according to FIG. 3. In this case, the guide roller may be driven by means of a DC motor or a stepping motor. Corresponding rotary transducers have to be provided for monitoring the position. In any event, however, the drive 7 is operatively coordinated with the drive of the ejectors 24, 25, as can be gathered from the manner of operation described.

What is claimed is:

1. A device for the transfer of harness elements from a conveying member, in a drawing-in machine for warp yarns, onto at least one carrying member of a weaving machine that has an ejector for removing the harness elements from the conveying member, the device comprising a guide roller for the harness elements which is mounted rotatably about an axis and which has guides for the carrying member which guide the carrying members in two orthogonal directions.

2. A device according to claim 1, wherein the guide roller has a recess that starts from the circumference and extends towards the axis.

3. A device according to claim 2, wherein the recess has a boundary which acts as a guide surface on the guides to propel the harness elements forward.

4. A device according to claim 3, wherein the guide roller has a plurality of recesses for propelling a plurality of carrying members next to one another.

5. A device according to claim 1, wherein the guide roller has a plurality of guides for guiding a plurality of carrying members next to one another.

6. A device according to claim 2, wherein the recess of the guide roller together with the carrying member form a transfer lock for the harness elements.

7. A device according to claim 1, wherein the guide roller is arranged proximate to one end of the carrying member.

8. A device according to claim 1, wherein the guide roller has a first drive which is adapted to be operatively coordinated with a second drive that drives the ejectors.

* * * * *